US006431087B1

(12) United States Patent
Kotani

(10) Patent No.: US 6,431,087 B1
(45) Date of Patent: Aug. 13, 2002

(54) SYSTEM TABLE WITH COORDINATE-INPUT DEVICE INCORPORATED

(75) Inventor: Yoshihiro Kotani, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 09/701,573

(22) PCT Filed: Jun. 28, 1999

(86) PCT No.: PCT/JP99/03482

§ 371 (c)(1),
(2), (4) Date: Jan. 24, 2001

(87) PCT Pub. No.: WO00/00061

PCT Pub. Date: Jan. 6, 2000

(30) Foreign Application Priority Data

Jun. 29, 1998 (JP) ..... 10/182418

(51) Int. Cl.[7] ..... A47B 37/00
(52) U.S. Cl. ..... 108/50.01
(58) Field of Search ..... 108/50.01, 50.02; 312/223.3, 233.6

(56) References Cited

U.S. PATENT DOCUMENTS 3,828,695 A 8/1974 Skarky
5,694,861 A * 12/1997 Laukamm-Josten ..... 108/50.01
5,758,934 A * 6/1998 Flutka et al. ..... 108/50.01 X
6,016,755 A * 1/2000 Trapani ..... 108/50.01
6,152,046 A * 11/2000 Schairbaum et al. . 108/50.01 X
6,237,507 B1 * 5/2001 Yanagisawa et al. 108/50.01 X
6,269,753 B1 * 8/2001 Roddan ..... 108/50.01

FOREIGN PATENT DOCUMENTS

| | | |
|---|---|---|
| JP | 3-94451 | 6/1993 |
| JP | 5-40544 | 7/1993 |
| JP | 3-103935 | 7/1993 |
| JP | 6-274245 | 9/1994 |
| JP | 6-315416 | 11/1994 |

OTHER PUBLICATIONS

European Search Report date May 4, 2001.

* cited by examiner

*Primary Examiner*—Jose V. Chen
(74) *Attorney, Agent, or Firm*—Arent Fox Kintner Plotkin & Kahn, PLLC

(57) ABSTRACT

A coordinate input device containing system table having a table portion for mounting thereon a monitor, a computer body and the like. The table portion includes a front table surface portion of flat and seamless as a whole, a top board having an accommodating portion formed to accommodate the coordinate input device in a lower level than the front table surface portion in a state of readiness to use, and a holding member fixed to the table portion at a reverse side thereof to support and fix the coordinate input device accommodated in the accommodated portion formed in the top board.

5 Claims, 3 Drawing Sheets

Fig.1-b
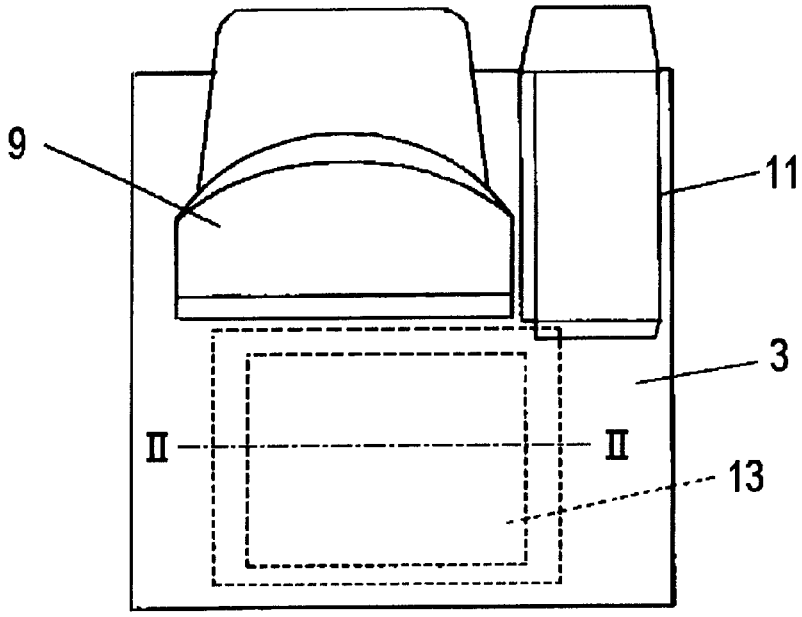
Fig.1-a
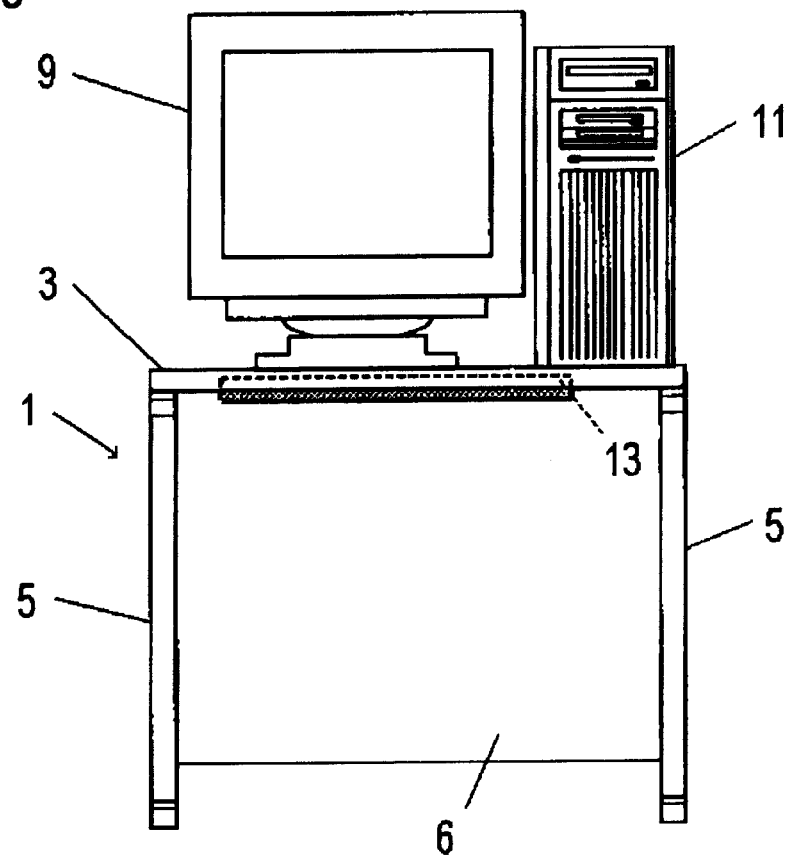

Fig.3-b
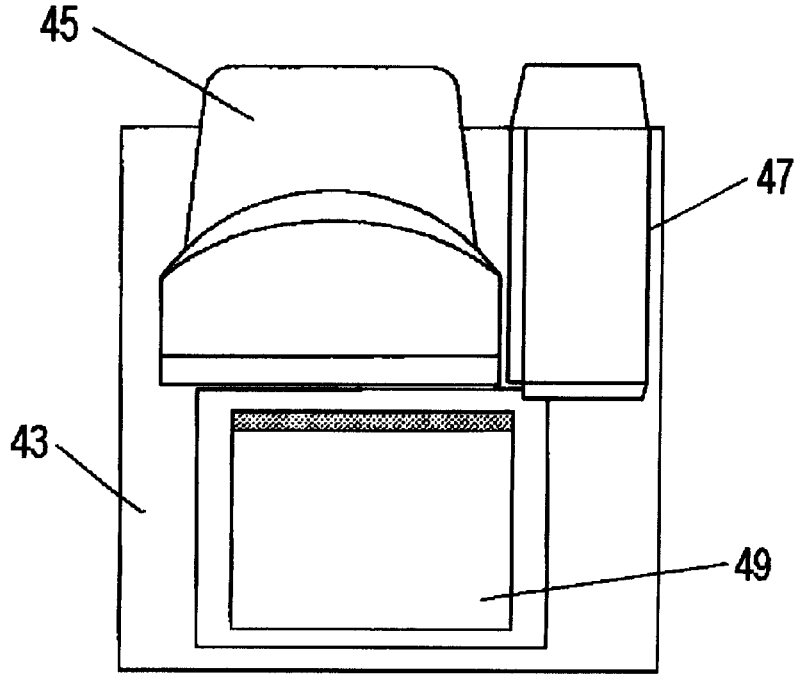
Fig.3-a
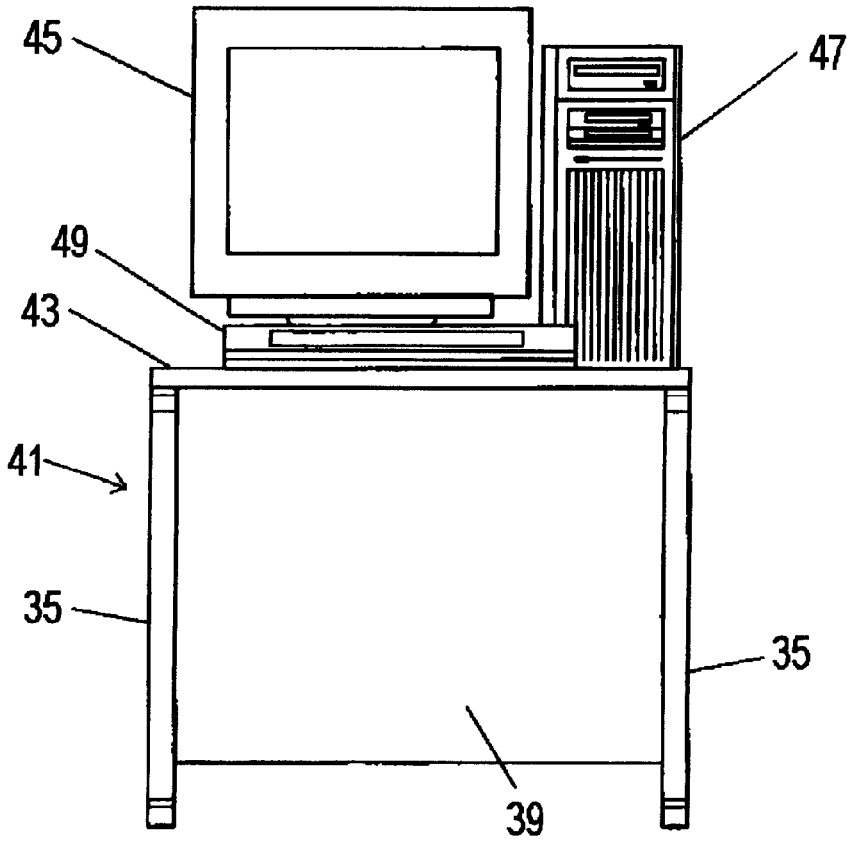

SYSTEM TABLE WITH COORDINATE-INPUT DEVICE INCORPORATED

TECHNICAL FIELD

The present invention relates to a system table for mounting a monitor and a computer body thereon.

BACKGROUND ART

A conventional system table 41 is shown in FIG. 4. FIG. 4-*a* shows the front view thereof and FIG. 4-*b* shows the plan view thereof. A table 43 comprises legs 35, 35, a back cover 39 and a top board 37. Mounted on the table 43 are a monitor 45, a computer body 47 and a coordinate input device 49 such as a digitizer and the like.

The coordinate input device 49 juts out from the table in front of which an operator is seated, and as such produces level difference there between. The level difference forms an obstacle when the operator works on the table without using the coordinate input device 49. Also, the level difference produces the disadvantage that the table cannot be used effectively even when the operator performs computer operation using the coordinate input device 49, thus presenting the problem of degradation of workability.

It is an object for the present invention to provide a system table having the top that can be used effectively.

DISCLOSURE OF THE INVENTION

According to the present invention, in a coordinate input device containing system table having a table portion for mounting thereon a monitor, a computer body and the like, the table portion comprises a front table surface portion formed to be flat and seamless as a whole, a top board integrally formed with the front table surface portion and having an accommodating portion formed to accommodate the coordinate input device in a lower level than the front table surface portion in a state of readiness to use by cutting out the top board integrally combined with the front table surface portion, and a holding member fixed to the table portion at a reverse side thereof to support and fix the coordinate input device accommodated in the accommodated portion formed in the top board. With this arrangement, since the front table surface is formed to be flat and seamless as a whole and also the coordinate input device is accommodated in a lower level than the front table surface in a state of readiness to use, an operator can always use the front table surface effectively.

BRIEF DESCRIPTION OF THE DRAWINGS

FIG. 1 shows a computer system having a system table of the first embodiment of the present invention wherein a coordinate input device is housed. FIG. 1-*a* shows the front view thereof and FIG. 1-*b* shows the plan view thereof.

FIG. 3 shows a conventional system table. FIG. 3-*a* shows the front view thereof and FIG. 3-*b* shows the plan view thereof.

BEST MODE FOR CARRYING OUT THE INVENTION

EXAMPLE

Figure 2:
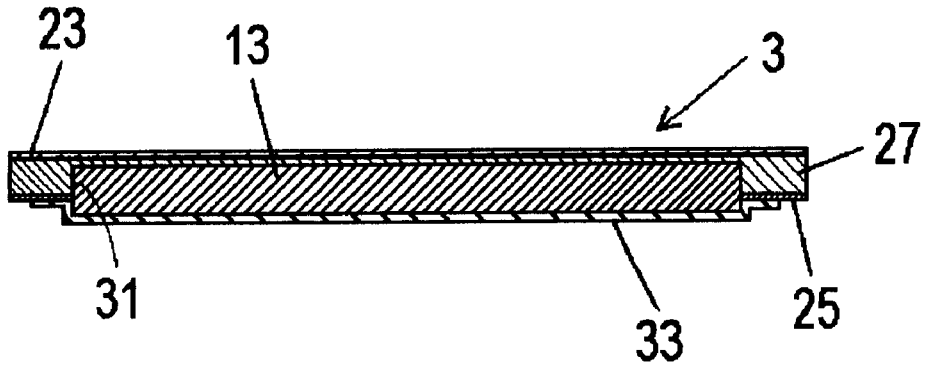
FIG. 2 shows a sectional view of a table portion of the system table taken along the line II—II of FIG. 1.

Illustrated in FIG. 1 is a computer system having a system table of the first embodiment of the present invention wherein a coordinate input device is housed. FIG. 1-*a* shows the front view thereof and FIG. 1-*b* shows the plan view thereof.

The system table 1 shown in the figures comprises a table portion 3 including a top board 7, right and left legs 5, 5 and a back cover 6. A monitor 9 and associated equipment such as a computer body 11 are put on the table 3 at a center part thereof and at a lateral side thereof, respectively. A coordinate input device 13 is built in the table portion 3 at a part thereof ahead of the monitor 9.

Description on the table portion 3 will be given with reference to FIG. 2 showing a sectional view of the table portion 3 of the system table taken along the line II—II of FIG. 1.

A table portion 3 of this embodiment is formed of plywood composed of three layers of an upper decorative laminate panel 23, a lower decorative laminate panel 25 and a top board body portion 27 sandwiched therebetween, all of which are stuck together. The upper and lower decorative laminate panels 23, 25 each have thickness of 2 mm and the top board body portion 27 has thickness of 18 mm. In this embodiment, in order for the table portion 21 to have an accommodating portion 31 for the coordinate input device 13, the decorative laminate panel 25 and the top board body portion 27 are cut off from the reverse side with cutting equipment such as a router in such a manner that the thickness of about 5 mm may remain at the front side of the table portion. Fitting 33 is screwed to the top board 7 at a reverse side thereof as a holding member to hold the coordinate input device 13 in the accommodating portion of the top board. The coordinate input device 13 is fixed with its being accommodated in the accommodating portion 31 formed in the table 3, as described above.

In the system table of the embodiment, an operator cannot visually recognize in which part of the table the coordinate input device is arranged when viewed from the front surface side of the table, but he/she can operate the coordinate input device without trouble, as long as the indication of the cursor on the monitor 9 corresponds one to one to coordinate system of the coordinate input device 13.

The table thus constructed enables the input operation with the touch pen or the mouse running over the table surface, as is the case with the conventional table. Since the front surface of the table portion 3 is formed to be seamless and flat, the table top can be used effectively, whether or not the computer operation is performed, and as such can produce improved workability.

It is desirable that appropriate materials be selected for the front surface of the table and the nib of the touch pen to prevent abrasion in longterm operation.

CAPABILITIES OF EXPLOITATION IN INDUSTRY

According to the present invention, since the table portion of the system table is so structured as mentioned above, the table can be used effectively.

What is claimed is:

1. A coordinate input device containing a system table having a table portion for mounting thereon a monitor and a computer body, the table portion comprising:

a flat and seamless front table surface portion;

a top board having an accommodating portion formed therein to accommodate the coordinate input device in a level that is lower than a level of the front table surface portion, wherein the coordinate input device is in a ready to use state; and holding means fixed to a reverse side of the table portion opposite the front table surface portion for holding the coordinate input device accommodated in the accommodating portion formed in the top board, wherein the accommodating portion is formed by cutting the reverse side of the top board of the table portion.

2. The system table according to claim 1, wherein the holding means comprises a fitting that is screwed into the top board.

3. The system table according to claim 1, wherein the table portion is comprised of plywood.

4. The system table according to claim 3, wherein the plywood comprises an upper decorative laminate panel attached to a top surface of the top board and a lower decorative laminate panel attached to a lower surface of the top board.

5. The system table according to claim 4, wherein the upper and lower decorative laminate panels have a thickness of 2 mm and the top board has a thickness of 18 mm.

* * * * *